United States Patent [19]

Parent

[11] 4,295,578

[45] Oct. 20, 1981

[54] CONTRACTABLE CLOSURE MEMBER

[75] Inventor: Daniel Parent, St-Hyacinthe, Canada

[73] Assignee: Plastiques Modernes Ltee., Quebec, Canada

[21] Appl. No.: 128,452

[22] Filed: Mar. 10, 1980

[51] Int. Cl.[3] ..... B65D 53/00

[52] U.S. Cl. ..... 220/234; 215/359; 222/484; 220/233

[58] Field of Search ..... 220/237, 234, 338; 222/484, 563, 479, 481; 215/359; 138/89

[56] References Cited

U.S. PATENT DOCUMENTS

| | | | |
|---|---|---|---|
| 3,756,480 | 9/1973 | Swett et al. | 220/234 X |
| 4,083,468 | 4/1978 | Batchelor | 220/238 X |

*Primary Examiner*—George T. Hall

*Attorney, Agent, or Firm*—Oblon, Fisher, Spivak, McClelland & Maier

[57] ABSTRACT

The invention relates to a contractable closure member for sealing an open-ended container. The closure member comprises a top wall formed of a rigid material and an elastic bottom wall formed of a flexible material and having an upwardly extending continuous side wall. The side wall has a seal formed integral therewith, and this wall is securable to the top wall whereby the bottom wall is held in spaced relationship with the top wall. A retracting lever is pivotally secured in the top wall and has an engagement end and a pusher end. The pusher end is arcuately displaceable against a central portion of the bottom wall to distend the bottom wall whereby the side wall will be drawn inwardly to remove sealing pressure when positioned for sealing engagement in an open-ended container.

20 Claims, 11 Drawing Figures

CONTRACTABLE CLOSURE MEMBER

BACKGROUND OF INVENTION (a) Field of the Invention

This invention relates to an improved contractable closure member for sealing open-ended containers.

(b) Description of Prior Art

Contractable closure members for sealing open-ended containers are known. However, those known closure members either have an actuable element protruding from the top wall of the cover and are restricted to circular-shaped closures in order to obtain substantially uniform radial stretching of the closure bottom wall.

SUMMARY OF INVENTION

It is a feature of the present invention to provide a contractable closure member of an improved construction which provides advantages over known contractable closure members.

It is a further feature of the present invention to provide a contractable closure member wherein the top wall thereof is substantially flat thereby permitting stacking of articles onto the cover and permitting a container having the cover to be stored in an area of smaller height than with prior art closure members. Also, the closure member being of substantially reduced thickness requires less space for storage and shipping.

A further feature of the present invention is to provide a contractable closure member which may have various contour configurations such as circular, rectangular, square, rectangular with rounded corners, etc.

A further feature of the present invention is to provide a contractable closure member requiring single-hand operation and which is easy to dismantle and clean.

A further feature of the present invention is to provide a contractable closure member having a retractable lever which is displaceable to two distinct positions when used with an open-ended container, thereby indicating that the closure member is in sealing engagement or in a non-sealing engagement with the container.

A further feature of the present invention is to provide a contractable closure member wherein the bottom elastic wall is constructed such as to coact with the retracting lever such as to permit substantially uniform stretching thereof when distended.

According to the above features, from a broad aspect, the present invention provides a contractable closure member for sealing an open-ended container. The closure members comprises a top wall and a bottom wall, the bottom wall being formed from an elastic material and having an integral continuous side wall. Seal means is formed with the side wall. The side wall is securable to the top wall with the bottom wall held in spaced relationship therewith. A retracting lever is pivotally secured to the top wall and has an engagement end and a pusher end. The pusher end is arcuately displaceable against a central portion of the bottom wall to distend the bottom wall whereby the side wall will be drawn inwardly to remove sealing pressure of the seal means when the closure member is positioned for sealing engagement in an open-ended container.

BRIEF DESCRIPTION OF DRAWINGS

A preferred embodiment of the present invention will now be described with reference to the example thereof as illustrated in the accompanying drawings in which.

DESCRIPTION OF PREFERRED EMBODIMENTS

Figure 1:
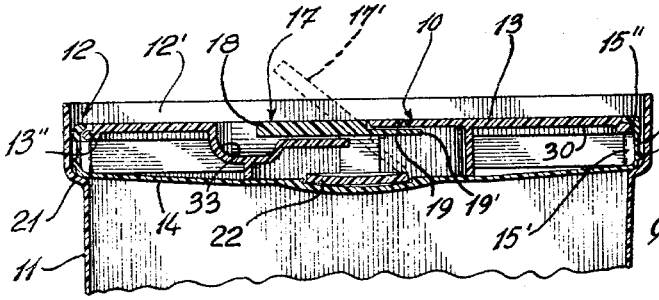
FIG. 1 is a sectional side view showing the construction of the contractable closure member positioned in an open-ended container.
Figure 2:
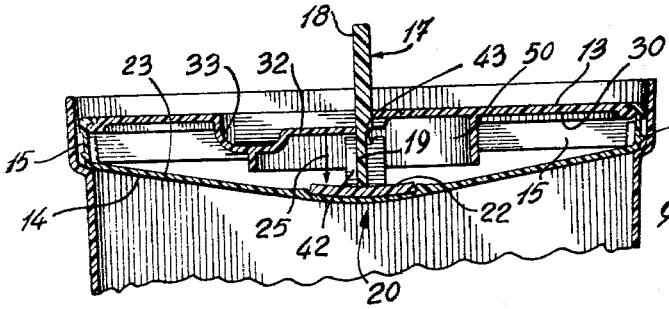
FIG. 2 is a sectional side view, as in FIG. 1, showing the contractable closure member with the elastic bottom wall distended by the retracting lever.

Referring now to the drawings, and more particularly to FIGS. 1 and 2, there is shown generally at 10, the contractable closure member positioned within the open top end 12 of an open-ended container 11. The closure member comprises a top wall 13, herein a rectangular top wall formed of a rigid thermoplastic material, such as polystyrene or polypropylene material. A bottom wall 14, FIG. 4, formed of an elastic material, such as low density polyethylene, and having an upwardly extending continuous side wall 15, formed therewith, is secured to the top wall 13 by a side wall 15. The side wall 15 spaces the bottom wall 14 from the top wall 13, as shown. A continuous seal bead 16, which constitutes seal means, is formed integrally with the side wall 15 and engages the inner wall 12' in the open top end portion 12 of the container 11 when the closure member is positioned therein with the bottom wall 14 being in a normal position as shown in FIG. 1.

A retracting lever 17 is pivotally secured to the top wall 13 in a manner which will be described in detail later, and defines an engagement end 18 and a pusher end 19. As seen in FIG. 1, by pulling the engagement end 18 of the lever 17 out of the plane of the top wall 13 (see phantom lines 17') the pusher end 19 is arcuately displaceable against a central portion 20 of the bottom wall 14 to distend the bottom wall whereby the side wall 15 will be drawn inwardly to remove sealing pressure by the seal bead 16 against the inner wall 12' in the open end portion 12 whereby to remove sealing engagement of the closure member 10 with the open-ended container. As shown in FIGS. 1 and 2, the open-ended container is preferably formed with an annular shoulder 21 whereby the closure member 10 will rest in the open top end portion 12 when the sealing pressure of the closure member is removed.

Figure 6:
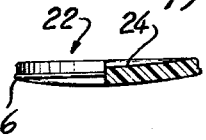
FIG. 6 is a side view of the disc.

Referring to FIGS. 1, 2 and 6, there is also shown a friction disc 22 removably secured to the inner face 23 of the bottom wall 14 over the central portion 20 thereof. The disc 22 has a concave top face 24 to receive the free end 19' of the pusher end 19 of the lever 17 in frictional displacement thereover when the engagement end of the lever is displaced outwardly of the top wall whereby to apply pressure in the direction of arrow 25 to space the bottom wall 14 away from the top wall 13 to distend the elastic bottom wall causing the side walls 15 to be retracted inwardly to remove sealing pressure as previously mentioned. The disc 22 is also formed of a rigid material such as polystyrene or polypropylene material and protects the bottom wall 14 from wear and further provides a better distribution of the pressure radially about the bottom wall 14.

The disc 22 is provided with a bottom shoulder 26 whereby the disc may be retained in a snap fit within a disc retaining cavity 27 (see FIGS. 4*a* and 4*b*) formed centrally in the inner top face 23 of the bottom wall 14. The disc retaining cavity 27 has a peripheral retaining ridge 28 to engage over the bottom shoulder 26 of the disc.

Figure 3:
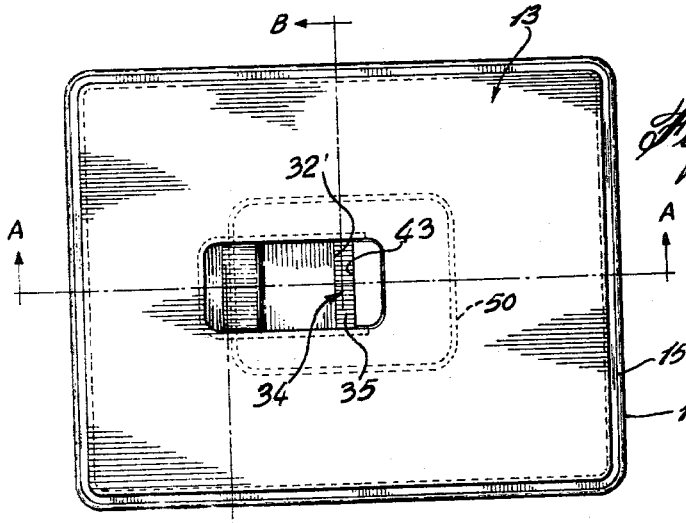
FIG. 3 is a top plan view of the contractable closure member.
Figure 3A:
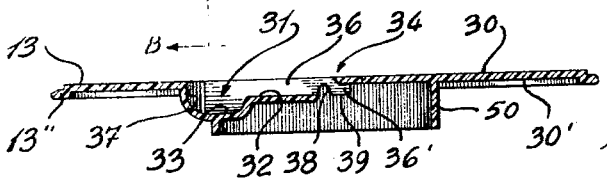
FIG. 3*a* is a cross-sectional side view along cross-section lines A—A of FIG. 3.
Figure 3B:
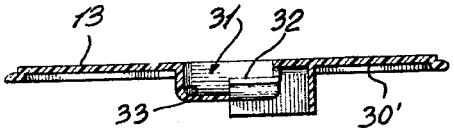
FIG. 3*b* is a cross-sectional side view along cross-section lines B—B of FIG. 3.

Referring now to FIGS. 3, 3*a* and 3*b*, there is shown the construction of the top wall 13. The top wall has a substantially uniform top surface 30 with a cavity 31 formed therein to house the retracting lever whereby the lever rests substantially in or below the plane of the top surface 30. The cavity 31 defines a flat support portion 32 spaced inwardly and substantially parallel to the top wall 13. The cavity also defines a finger insertion portion 33 at an end of the cavity 31 spaced from the top wall center portion 34 to permit finger engagement of the engagement end 18 of the lever 17, as is clearly shown in FIG. 1. The finger insertion portion 33 extends below the support portion 32 whereby the free end of the engagement end 18 of the lever extends over the portion 33 for ease of engagement of the lever.

As also seen from the illustrated embodiment, the cavity 31 is substantially of a rectangular shape and defines two parallel side walls 36 and an end side wall 37, located remotely from the central top portion 34. An opening 35 or slot is formed in the cavity 31 and located generally along the top center portion 34. The cavity 35 is formed by a cut-out portion in the flat support bottom wall 32 immediately under the said top wall central portion 34 and the space created by not having an end side wall portion of the cavity 31 in this area. Thus, the parallel side walls 36 form a free end portion 36' which extends across the opening at a respective end thereof. A pivot connection, herein a groove 38, is formed in the bottom edge 39 of the free end portion 36' of the side walls 36 whereby to retain the lever 17 and permit arcuate displacement thereof, as will be described later.

Figure 5A:
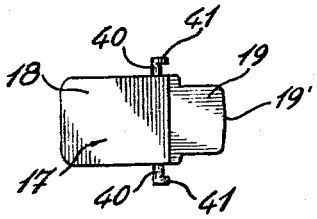
FIG. 5*a* is a plan view of the retracting lever.
Figure 5B:
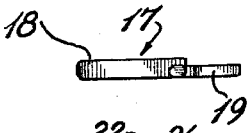
FIG. 5*b* is a side view of FIG. 5*a;*.

Referring now to FIGS. 1, 2, 5*a* and 5*b*, it can be seen that the lever 17 extends within the opening 35 and is pivotally secured on an axis extending substantially along the opening 35 which is shown in FIG. 3 as being an elongate rectangular slot. This pivot axis is formed along an axis passing through opposed pivot pins 40 located on each side of the retracting lever 17 which is shown in FIG. 5*a* as being generally of rectangular configuration. These pivot pins have an eccentric transverse end flange 41 which prevents the lever 17 from pivoting outwardly of the top wall when the container is angulated or placed upside down. These shoulders fit in a respective one of the grooves 43 of flanges 42, as described below, and the eccentric prevents free rotation of the pivot pins.

Figure 4:
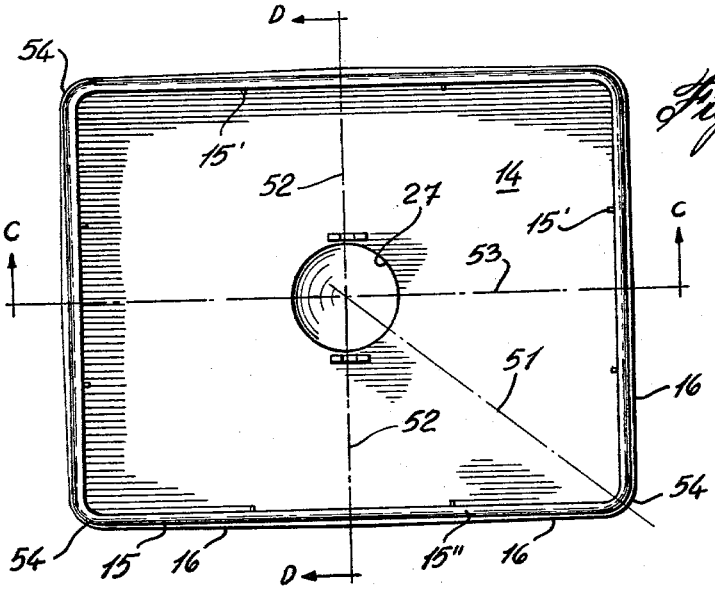
FIG. 4 is a top plan view of the bottom wall as seen from inside the closure member.
Figure 4A:
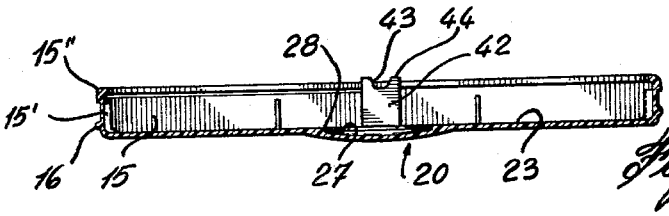
FIG. 4*a* is a cross-sectional side view along cross-section lines C—C of FIG. 4.
Figure 4B:
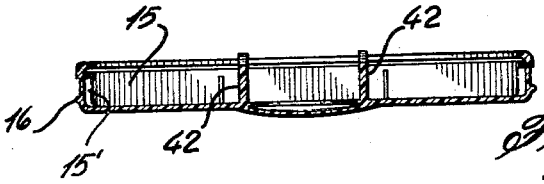
FIG. 4*b* is a cross-sectional side view along cross-section lines D—D of FIG. 4.

As shown in FIGS. 4*a* and 4*b*, the bottom wall 14 is further provided with a pair of upstanding flanges 42 extending from the inner top surface 23 of the bottom wall 14 and spaced on a respective side of the disc retaining cavity 27 and lie outwardly of the parallel side walls 36. Also, a recess or groove 43 is formed in the top edge 44 of each flange 42 with the grooves 43 lining up with respective flanges 41 of the pivot pins 40. As previously described, the flange 41 is of eccentric shape as well as the groove 43 and the upward pressure of the groove 43, due to its position relative to the top wall, cause the flange 41 to position itself in fitting engagement in the groove 43 to apply a closed biasing force on the lever to maintain the lever horizontally in a locked position.

The pivot pins of the retracting lever 17 are captive in the grooves 38 of the side wall 36 and the end flange 41 in groove 43 of the flange 42 when the lever is positioned horizontally within the cover. As soon as the retracting lever is pulled out of the cover to remove the clamping pressure, the pusher end 19 of the lever pushes the bottom wall 14 away from the top wall 13 thereby separating the grooves 43 from the grooves 38. However, in this position, a pressure exists along the plane of the lever maintaining the pivot pins 40 in the grooves 38. The retracting lever 17 is displaceable within an arc of approximately 90° and is stopped at its vertical position, as shown in FIG. 3, by the oppositely disposed terminal edges 32' and 13' of the flat support portion 32 and top wall 13 respectively. Thus, when the lever is fully retracted, it is maintained in a substantially vertical position, as shown in FIG. 2. This is an indication to the user that the cover, although positioned within the open-ended container, is in non-sealing engagement with the container 11. This is useful when it is not necessary to seal the container but to cover the open end and to permit easy removal of the cover such as when it is required to continuously insert foodstuff or other substance within the container.

As shown in FIG. 5*a*, the free end 19' of the pusher end 19 is slightly curved to conform to the concave top face 24 of the disc 22 to provide smooth frictional engagement therewith. Further, as shown in FIGS. 2, 3*a* and 3*b*, an annular continuous depending wall 50 depends from the inner face 30' of the top wall 13 to solidify the top wall in the lever area and to support the bottom wall 14 to prevent distortion thereof and to keep it in a slightly stretched (prestressed) condition whereby as soon as the retracting lever 17 is actuated and the pusher end engages the disc 22, the bottom wall will start retracting the side walls 15. Otherwise, if the bottom wall was not pre-stretched, the initial displacement of the pusher end against the disc would cause stretching of the bottom wall 14 at its central area before any retracting force is applied on the side wall 15, its outermost area. Therefore, it would be necessary to make the lever pusher end lower and requiring more force by the user to obtain the same results.

With reference to FIGS. 1, 3*a* and 4*a*, it can be seen that the top wall 13 is captive at designated points along its outer periphery between wall support ribs 15' and the overlap flange 15'', both formed with the side wall 15. The top wall 13 is provided with a circumferential flange 13'' formed integral therewith and recessed downwards from the top surface of the top wall 13. The flange 13'' lodges itself between the top edge of rib 15' and the lower edge of the flange 15'' to prevent the top wall 13 from collapsing in its circumferential area.

When the closure member is a circular closure member, as soon as the bottom wall 14 is distended, the side walls retract substantially uniformly as the spacing between the center and the side wall is substantially constant. However, with rectangular or square containers, the side wall 15 is not equidistantly spaced from the center. In order to maintain sealing pressure along the periphery of closure member 10 and to achieve substantially constant release of this pressure when the lever 17 is actuated, the seal bead 16 is slightly arced outwardly and thicker at the transverse central axis 52 and 53 of the rectangular closure, see FIG. 4. The thickness of the bead 16 gradually diminishes towards the corners 54 of the cover. Thus, when the lever is retracted, more stretching of the bottom wall 14 will be required along the axes 52 and 53 before the bead in the corners 54 retracts whereby the bead will retract substantially at the same time throughout the circumference of the closure member.

Furthermore, in order to improve uniform retracting displacement of the side wall 15 the bottom wall 14 may be molded with a non-uniform thickness. For example, as shown in FIG. 4, the material along the axis 51, which is the longest point between the side wall 15 and the center of the closure member, would be thicker and decrease towards the axis 52 which is the shortest point from the center to the side wall. Thus, the elasticity of the bottom wall would vary throughout the surface area thereof.

Another means for causing substantially uniform withdrawing of the side wall, when the bottom wall is distended, is achievable by modifying the disc 22 whereby it has a contour which matches the contour of the side wall of the closure member. Thus, the disc being formed of a rigid material would extend substantially parallel and equidistantly spaced from the side wall 15 and distribute the downward pressure in a substantially uniformly spaced area on the bottom wall 14. Alternatively, the bottom wall 14 could be constructed with a thicker central base portion also contoured to be in equidistantly spaced parallel relationship with the side wall, much like the disc, except it would be molded integral with the bottom wall.

It should be understood that an important feature of the present invention resides in the provision of a closure member having a distendable bottom wall which can retract a side wall which is not of circular contour. It is foreseen that a closure member of circular contour and having a straight edge portion in the contour could have the side wall thereof retracted substantially uniformly by the provision of a matching contoured disc or a thicker central portion or the provision of varying thicknesses in the bottom wall and extending radially to the portions furthermost from the central portion of the bottom wall.

It is within the ambit of the present invention to cover any obvious modifications of the example of the preferred embodiment described hereinabove, provided such modifications fall within the scope of the broad claims appended hereto. For example, instead of the container having a shoulder 21, it may have a straight wall and the closure member could be provided an overlapping edge. Further, the lever 17 and its cavity could have different shapes provided they perform the same function.

I claim:

1. A contractable closure member for sealing an open-ended container, said closure member comprising a top wall, a bottom wall formed from an elastic material and having an integral continuous side wall, seal means in said side wall, said side wall being securable to said top wall with said bottom wall held in spaced relationship therewith, a retracting lever pivotally secured below said top wall and having an engagement end and a pusher end, said pusher end being arcuately displaceable against a central portion of said bottom wall to distend said bottom wall whereby said side wall will be drawn inwardly to remove sealing pressure of said seal means when said closure member is positioned for sealing engagement with an open-ended container.

2. A closure member as claimed in claim 1 wherein said top wall has a uniform top surface, said retracting lever when in a non-use position lying entirely substantially in or below said top surface and being pivotally secured to said top wall.

3. A closure member as claimed in claim 2 wherein a cavity is formed in said top wall and having a bottom wall, said lever extending through said cavity, said engagement end of said lever lying in said cavity when said lever is in its non-use position.

4. A closure member as claimed in claim 3 wherein said cavity bottom wall defines a flat support portion spaced inwardly of and substantially parallel to said top wall, and a finger insertion portion at an end of said support portion and extending below said support portion whereby a free end of said engagement end extends over a portion thereof when said lever is in its non-use position to permit finger engagement of said engagement end.

5. A closure member as claimed in claim 3 wherein an opening is provided in an end of said cavity and disposed substantially central of said top wall, said lever extending in said opening and being pivotally secured on a pivot axis parallel to said opening whereby said engagement end extends over said cavity bottom wall when said lever is in its non-use position.

6. A closure member as claimed in claim 5 wherein said cavity defines two elongated parallel side walls and an end wall opposite said cavity, said parallel side walls having a free end portion extending across said opening at a respective end of said cavity, a pivot connection in said side wall adjacent said opening, said lever being engaged in said pivot connection.

7. A closure member as claimed in claim 6 wherein said lever has opposed pivot pins and an eccentric transverse end flange, said pivot connection being a groove in a lower edge of said side walls, said elastic bottom wall having a pair of upstanding flanges extending from an inner surface thereof and in offset alignment with said free end portion of said parallel side walls, an eccentric groove in a top edge of said flanges in alignment with a respective one of said end flanges, said pivot pins being captive between a respective offset pair of said opposed grooves when said lever is in its non-use position.

8. A closure member as claimed in claim 7 wherein said lever pusher end is a rigid free end.

9. A closure member as claimed in claim 8 wherein a friction disc is removably secured to a central portion of said inner surface of said elastic bottom wall, said disc having a concave top face, said free end of said pusher end of said lever frictionally engaging said concave top face and displaceable over a portion thereof when said engagement end of said lever is displaced outwardly of said cavity towards a transverse plane of said top wall.

10. A closure member as claimed in claim 9 wherein a disc retaining cavity is formed centrally of said elastic bottom wall, said disc cavity having a peripheral retaining shoulder, said disc being retained in said retaining cavity by said retaining shoulder captive in said side wall recess, said free end of said lever pusher end being slightly curved to conform with the surface of said concave top face of said disc.

11. A closure member as claimed in claim 3 wherein said seal means is an outwardly extending peripheral bead formed integral with said side wall, said engagement end being displaceable from the plane of said top wall to a position transverse to said top wall to effect said arcuate displacement of said pusher end.

12. A closure member as claimed in claim 11 wherein said top wall and said cavity bottom wall have oppositely disposed terminal edges to limit the displacement of said lever to said transverse position.

13. A contractable closure member as claimed in claim 1 wherein said bottom wall is molded from an elastic material of varying thickness, said side wall being varyingly spaced from the center of said bottom wall, said thickness varying in relation to the spacing of said side wall from said center and extending radially from said central portion to said side wall.

14. A contractable closure member as claimed in claim 1 wherein said top wall is molded from rigid material such as polystyrene, polypropylene, or the like, said bottom wall being molded from a low density polyethylene.

15. A closure member as claimed in claim 1 in combination with an open-ended container, said container having a peripheral sealing wall portion adjacent an open end thereof, said continuous side wall having a contour for close fit in said container open end adjacent said sealing wall.

16. A closure member as claimed in claim 1 or 15 wherein said side wall is upwardly extending from said bottom wall.

17. A closure member as claimed in claim 15 wherein said central portion of said bottom wall is of greater thickness than the remainder portion of said bottom wall, said central portion having a contour matching the contour of said side wall and disposed concentrically therewith.

18. A closure member as claimed in claim 15 wherein said means causing substantially uniform withdrawing comprises a disc of rigid material retained against an inner face of said bottom wall over said central portion, said disc having a contoured shape matching the contour of said side wall and disposed concentrically therewith.

19. A closure member as claimed in claim 15 or 17 wherein said displaceable element is a retracting lever pivotally secured below said top wall and having an engagement end and a pusher end, said pusher end being arcuately displaced against said central portion of said bottom wall by displacing said engagement end outwardly of the plane of said top wall.

20. A closure member as claimed in claim 15 or 17 wherein said container open-end and closure member are of rectangular contour shape.

* * * * *